United States Patent [19]

Vetter et al.

[11] 4,454,028

[45] Jun. 12, 1984

[54] CAN SORTING METHOD AND APPARATUS

[75] Inventors: Robert R. Vetter, Westwood Hills; John L. Aker, Shawnee, both of Kans.

[73] Assignee: Point of Purchase Recycling, Inc., Kansas City, Mo.

[21] Appl. No.: 403,577

[22] Filed: Jul. 30, 1982

[51] Int. Cl.[3] ..... B07C 5/00; G07F 7/06

[52] U.S. Cl. ..... 209/548; 194/4 C; 194/4 E; 209/551; 209/556; 209/557; 209/570; 209/595; 209/632; 209/666; 209/698; 209/910

[58] Field of Search ..... 194/4 R, 4 B, 4 C, 4 D, 194/4 E, 4 F, 4 G; 100/902; 209/546, 548, 549, 551, 552, 555, 556, 557, 558, 567, 570, 592–595, 698, 910, 912, 919, 632, 660, 666, 571; 198/397, 443; 221/182–184, 203

[56] References Cited

U.S. PATENT DOCUMENTS

| | | | |
|---|---|---|---|
| Re. 27,643 | 5/1973 | Myers | 194/4 R |
| 671,646 | 4/1901 | Bailey | 209/666 |
| 2,790,532 | 4/1957 | Albertoli . | |
| 2,943,306 | 6/1960 | Gray et al. | 324/233 X |
| 3,246,752 | 4/1966 | Wilson et al. | 209/698 X |
| 3,295,659 | 1/1967 | Aidlin . | |
| 3,338,373 | 8/1967 | Aidlin et al. | 198/397 |
| 3,434,595 | 3/1969 | Seaborn et al. | 209/595 |
| 3,539,005 | 11/1970 | Nekvinda | 209/570 |
| 3,650,368 | 3/1972 | Nalbach . | |
| 3,662,872 | 5/1972 | Nalbach . | |
| 3,776,128 | 12/1973 | Morris . | |
| 3,792,765 | 2/1974 | Arp | 194/4 C |
| 3,857,334 | 12/1974 | Arp . | |
| 3,907,087 | 9/1975 | Tanaka . | |
| 3,939,966 | 2/1976 | Szenczy . | |
| 3,955,179 | 5/1976 | Planke . | |
| 4,094,411 | 6/1978 | Kronseder et al. | 209/666 X |
| 4,108,065 | 8/1978 | Unger | 100/902 X |
| 4,130,194 | 12/1978 | Schindel et al. . | |
| 4,179,018 | 12/1979 | Miller | 194/4 R |
| 4,241,821 | 12/1980 | Wu et al. | 194/4 C |
| 4,248,334 | 2/1981 | Hanley et al. . | |
| 4,248,389 | 2/1981 | Thompson et al. | 209/546 X |
| 4,285,426 | 8/1981 | Cahill | 194/4 C |
| 4,317,521 | 3/1982 | Clark et al. | 209/558 |
| 4,324,325 | 4/1982 | Dewoolfson . | |
| 4,345,679 | 8/1982 | De Woolfson | 194/4 C |

FOREIGN PATENT DOCUMENTS

| | | | |
|---|---|---|---|
| 52-8683 | 1/1977 | Japan | 194/4 C |

OTHER PUBLICATIONS

Cangaroo Brochure, Alcoa, Feb. 8, 1981.
CoinBak, Brochure, CoinBak, Inc., May 1982.
Can Master Brochure, J. T. Newman Corp., May 1982.

*Primary Examiner*—David A. Scherbel
*Assistant Examiner*—Edward M. Wacyra
*Attorney, Agent, or Firm*—Litman, Day & McMahon

[57] ABSTRACT

An article or can sorting apparatus for separating articles having a recycle value from articles having no recycle value is defined by an annular article supporting surface positioned at about 45 degrees to horizontal, a cylindrical wall positioned in relation to the surface to define an article processing chamber, a feed hopper into which a plurality of the articles are deposited for feeding into the chamber, and an article conveying disc or wheel positioned in parallel relation to the surface and having a plurality of outwardly extending article pusher arms for separating the articles, such as discarded beverage cans, from the plurality of articles and conveying the articles one at a time about the annular surface to a material discriminator and a weight scale and toward an accept door or a reject door. The material discriminator or metal detector, the scale, and the accept and reject doors form segments of the article conveying surface. The apparatus is preferably controlled by a computer; and on the basis of the material and weight determinations, each article is either accepted for recycling or rejected and returned to a customer. The number of accepted articles is counted, and a printer is provided for printing out a tape documenting the money payout due the customer for the recycled articles.

33 Claims, 21 Drawing Figures

Fig. 12.
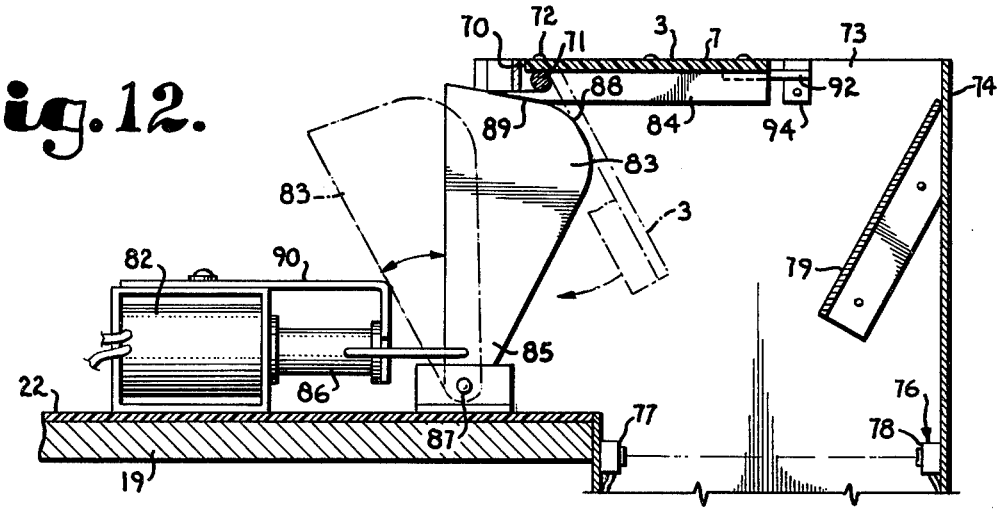
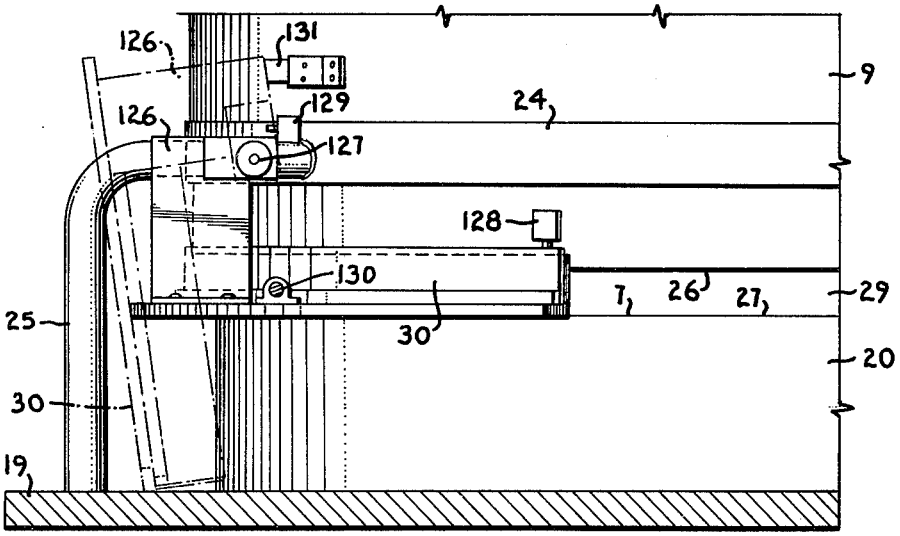
Fig. 13.
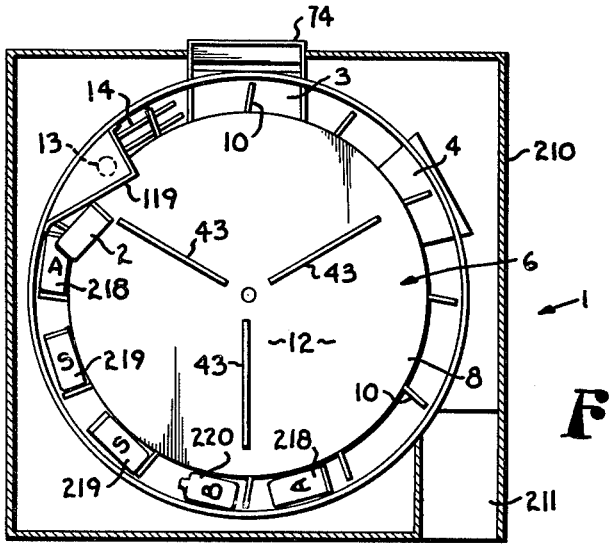
Fig. 14.

CAN SORTING METHOD AND APPARATUS

FIELD OF THE INVENTION

The present invention relates to article handling apparatus and, more particularly, to a customer operated machine for receiving a plurality of articles and for separating, counting, and documenting the count of acceptable articles and for returning the unacceptable articles to the customer.

BACKGROUND OF THE INVENTION

In current times, the need for the recycling of materials has been recognized because of the cost of energy in processing virgin materials, the need for ecological conservation, and for other reasons. One material which lends itself particularly well to recycling is aluminum. Substantial cost savings can be realized in the use of recycled aluminum as compared to the cost of mining and smelting virgin aluminum. One of the major uses of aluminum is in beverage cans. Current estimates are that about 40 to 50 billion aluminum cans are produced, used, and discarded annually in the United States. The majority of these cans are not recycled, but end up in landfills. Some of the hindrances to more widespread recycling of aluminum cans is the relative inconvenience of saving cans and the relative scarcity of can recycling centers. Those who would be willing to recycle cans are sometimes discouraged by the need to accumulate and store a sufficient number of cans to justify a trip to a can return center.

Points of purchase of canned beverages, such as groceries, convenience stores, liquor stores and the like, would be ideal return centers because of their widespread and dispersed locations in communities and neighborhoods. However, proprietors of these establishments are often reluctant to take on the added burden of accepting cans for recycling because of the space required for storage and the time and labor involved in receiving, counting, checking, and weighing the received cans.

SUMMARY OF THE INVENTION

The present invention overcomes many of the above enumerated objections and difficulties in can recycling by automating a large portion of the operations necessary in receiving aluminum cans for recycling. The can sorting apparatus is adapted for the customer to deposit a plurality of cans into a hopper and press a start button and a mode button; and the apparatus is operative to determine if each article is aluminum and if it is of the proper weight for an empty can. Articles other than aluminum cans are returned to the customer while aluminum cans of the proper weight are accepted and counted. When all the articles have been run, the apparatus displays the accepted can count, the current redemption value per unit weight of aluminum, and the money payout to the customer. A ticket is printed bearing the same information for submission to a clerk for redemption. The apparatus is also adapted for processing deformed aluminum cans which would otherwise be rejected from the machine because of their size. Thus, the commercial establishment is relieved of a great deal of the tedious labor involved in recycling aluminum cans whereby such an establishment would be more willing to provide aluminum can recycling services.

OBJECTS OF THE INVENTION

The principal objects of the present invention are: to provide a method and apparatus for promoting the recycling of the materials constituting certain consumer items; to provide an improved method and apparatus for sorting articles; to provide such a method and apparatus particularly for separating aluminum beverage cans for recycling from a random plurality of cans, bottles, and the like; to provide such an apparatus which may be loaded with a random plurality of deformed and non-deformed cans, bottles, and the like and which will accept and count empty non-deformed aluminum cans and which will return all other objects entered thereinto to the customer; to provide such an apparatus which employs a tilted rotary conveyor and gravity to separate individual articles from the plurality thereof entering the apparatus; to provide such an apparatus which has openings in the periphery thereof to allow very small articles and trash to be ejected from the machine; to provide such an apparatus wherein the size of the feed opening in the feed hopper limits the maximum size of articles which may be loaded into the machine; to provide such an apparatus including a metal detector operative to distinguish aluminum from other metals and materials; to provide such an apparatus which weighs the articles and rejects overweight articles, that is, articles to which weight has been added in an attempt to inflate the reimbursement therefor; to provide such an apparatus which may be set to accept and count deformed aluminum cans; to provide such an apparatus which may be adapted to sort and count articles other than aluminum cans; to provide such an apparatus which has an unjam mode for automatically clearing the machine if the articles get caught in such a manner as to prevent the conveyance of articles within the apparatus; to provide such an apparatus for installation in commercial establishments for operation by the general public; to provide such an apparatus which displays the count of accepted articles and which prints a tape or ticket bearing such a count along with the monetary reimbursement to the customer; and to provide such an article sorting apparatus which is economical to manufacture, durable and reliable in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 12 is a fragmentary sectional view taken on line 12—12 of FIG. 10 and illustrates an operating mechanism for the accept door.

FIG. 13 is an enlarged fragmentary elevation type view taken on line 13—13 of FIG. 4 and illustrates details of the deformed can door of the can sorting apparatus.

FIGS. 14–18 are diagrammatic views similar to FIG. 4 in orientation and illustrate the operation of the can sorting apparatus in processing aluminum cans (A), steel cans (S), and non-metallic bottles (B).

DETAILED DESCRIPTION OF THE PREFERRED EMBODIMENTS

Figure 1:
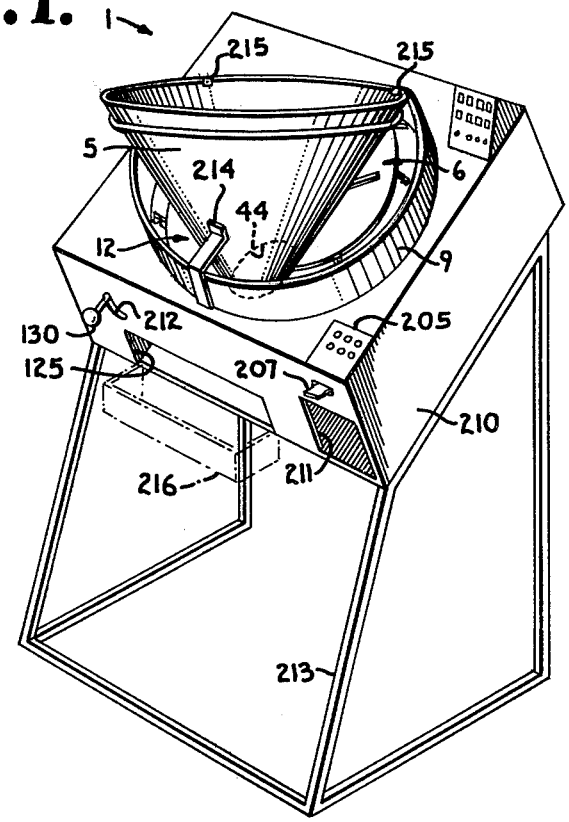
FIG. 1 is a perspective view illustrating a can sorting apparatus according to the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates an apparatus for sorting, determining the material of, and weighing articles 2, such as beverage cans, and on the basis of such determinations, either receiving the article 2 through an article accept means or accept door 3 or discharging the article through an article reject means or reject door 4. The apparatus 1 generally includes a hopper or funnel 5 for receiving the articles and feeding same into the apparatus 1 and an article processing chamber 6 defined by an article supporting surface 7, an article conveying wheel 8, and an article retaining wall 9. The surface 7 is annular and is positioned at an acute angle with respect to horizontal, such as 45 degrees. The wheel 8 is positioned in parallel spaced relation to the surface 7 and includes a plurality of circumferentially spaced and outwardly extending article pusher arms 10 operative upon rotation of the wheel 8 by a motor 11 to convey the articles 2 along or about the surface 7. The wall 9 is cylindrical and is substantially coaxial with the surface 7 and wheel 8. Because of the tilt of the chamber 6, and the spacing of the pusher arms 10, the wheel 8 operates as a singulating mechanism or conveyor such that as the articles are fed in a random pile into a lower portion 12 of the chamber 6, each pusher arm 10 catches preferably one article at a time from the pile. The articles 2 are thereupon conveyed in a stream of single articles toward a material detector 13, a scale 14, and, ultimately, to either the accept door 3 or the reject door 4.

The apparatus 1 is particularly adapted for operation and use by customers for returning aluminum cans for recycling of the aluminum thereof. For this purpose, the apparatus 1 is preferably provided with visual numeric displays 15 for displaying such information as the number of cans counted, the price per pound of aluminum which is reimbursible to the customer, and the monetary payout to the customer based on the number of cans accepted and counted. Further, the apparatus 1 is preferably provided with a printer 16 for printing a tape or ticket bearing the displayed information, or at least the payout amount, for submission to a clerk in the establishment in which the apparatus 1 is installed for reimbursement.

Figure 4:
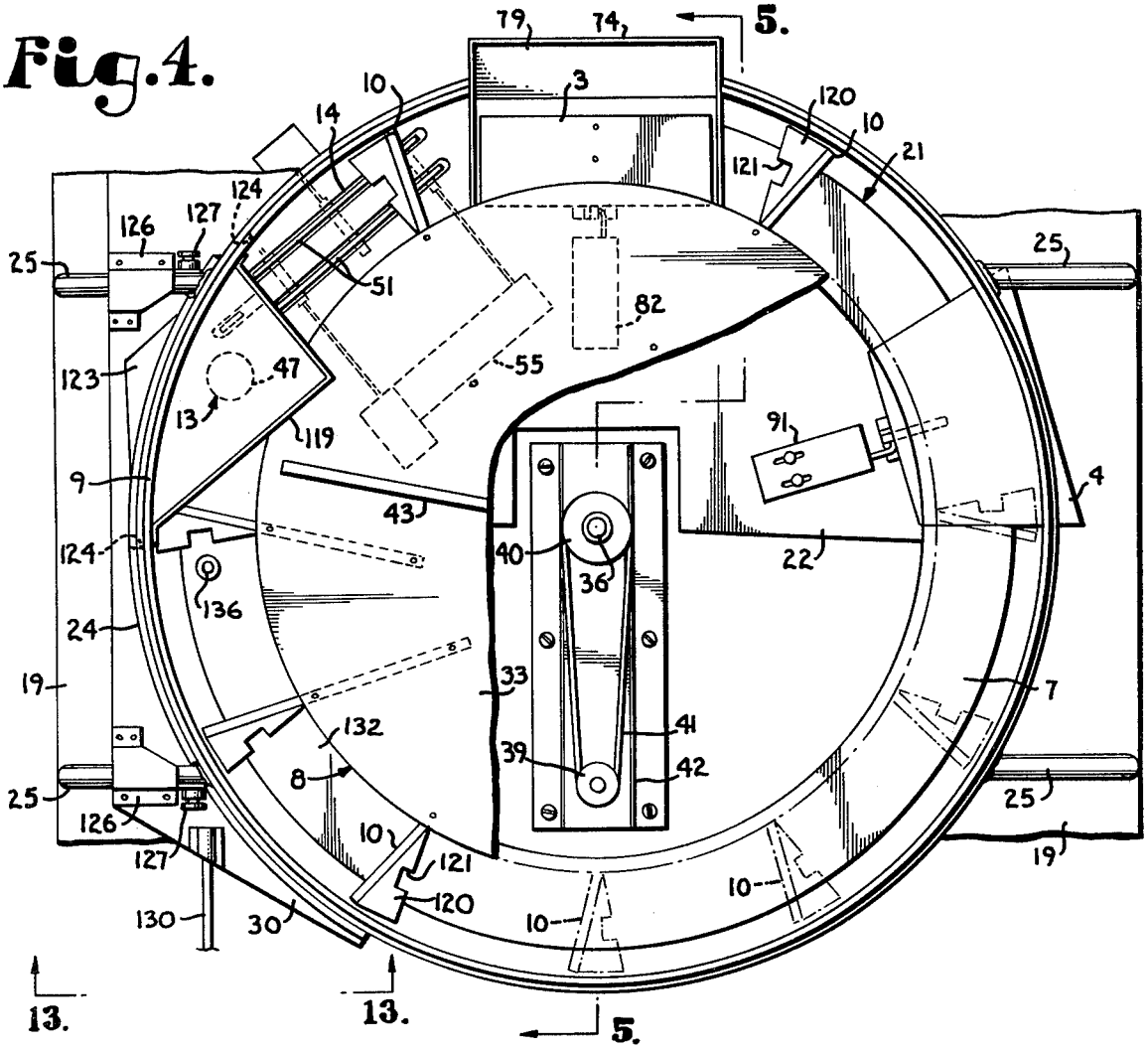
FIG. 4 is an enlarged fragmentary view similar to FIG. 3 with portions broken away to illustrate details of the can sorting apparatus.
Figure 5:
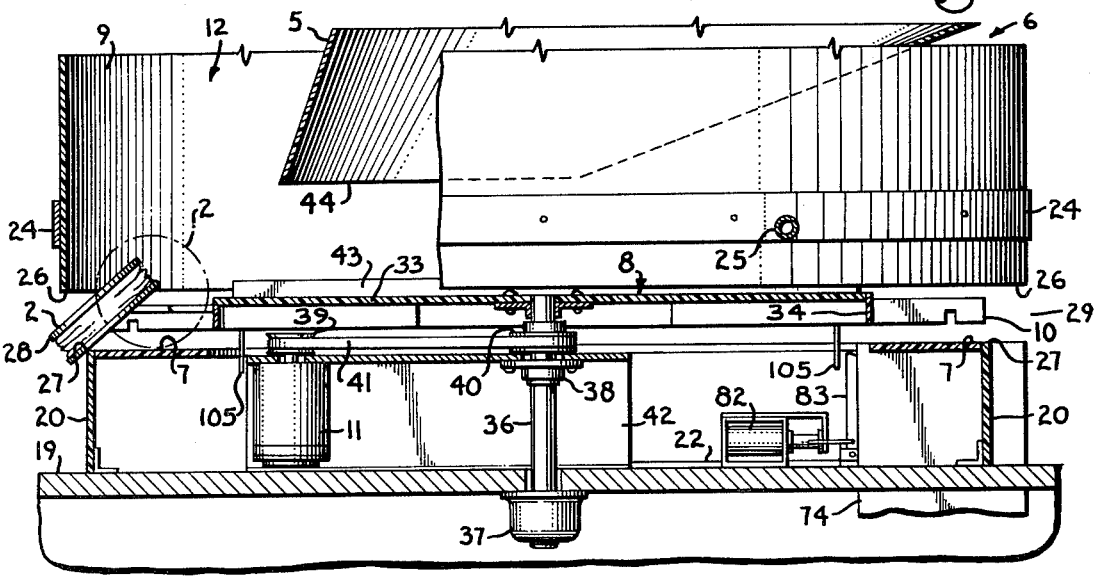
FIG. 5 is a fragmentary sectional view taken on line 5—5 of FIG. 4 and illustrates details of the article conveying mechanism of the can sorting apparatus.

The sorting apparatus 1 is constructed on a support base 19 such as the planar baseboard illustrated in FIG. 5. The article supporting surface 7 is preferably formed of low friction material, such as Teflon, which also resists adhesion by the possibly sticky beverage cans. The surface 7 may be constructed in segments or as a continuous sheet. As viewed in FIG. 4, the front half or lower half of the surface 7 is fixed to the support base 19, as by a cylindrical side wall 20. In order to provide for more convenient maintenance of the operating components, the metal detector 13, scale 14, accept door 3, and reject door 4 are constructed as a semicircular subassembly unit 21 interconnected by a lower plate 22. In this way, the subassembly unit 21 may be removed as a whole for periodic cleaning, repair, and adjustment.

The article retaining wall 9 may be supported in any suitable manner. The illustrated wall 9 is encircled by a band or strap 24 which is connected to the wall. The wall 9 is mounted on the base 19 by inverted L-shaped rods or brackets 25 which are attached between the base 19 and the wall 9. A lower edge 26 of the wall 9 is spaced from an outer perimeter 27 of the article conveying surface 7 so that trash and small articles, such as severely flattened cans 28 (FIG. 5), will be discharged from the apparatus 1 by gravity and centrifugal force as the articles 2 are conveyed about the surface 7 through a dropout opening or gap 29 between the edge 26 of the wall 9 and the outer perimeter 27 of the surface 27. As will be more fully described hereinafter, the apparatus 1 is capable of processing deformed cans and for this purpose is provided with a dropout door or deformed can door 30 which may be selectively closed to block the gap 29.

The article conveying means or wheel 8 generally consists of a center disc 33 having a cylindrical wall 34 depending from a periphery thereof. The disc 33 and wall 34 cooperate to support the pusher arms 10. The arms 10 are at a slight angle with respect to radial in the direction of rotation so that the arms engage the cans 2 substantially squarely. By this means, the articles follow a more circular path, and there is less tendency to drive partially deformed cans into the space between the lower edge 26 of the wall 9 and the outer edge 27 of the supporting surface 7 whereby jamming of the apparatus 1 might occur. The wheel 8 may be mounted for rotation in any suitable manner. As shown in FIG. 5, an axle 36 depends from the wheel 8 and is received in a rotary and thrust bearing 37 at a lower end of the axle 36 and in a rotary bearing 38 at an upper end thereof. The motor 11 is preferably a reversible motor for unjamming purposes, as will be more completely described hereinafter. The motor 11 may be drivingly engaged with the wheel 8 as by means of a drive pulley 39 on the motor shaft, a driven pulley 40 on the axle 36, and an endless belt 41 frictionally engaging the pulleys. The motor 11 and upper bearing 38 are preferably mounted on a motor bracket 42 which is attached to the support base 19. The illustrated wheel 8 is provided with a plurality of article agitating vanes 43 which are operative to rake the articles away from the lower opening 44 of the hopper 5 as the articles feed into the lower portion 12 of the processing chamber 6 to reduce jamming of articles in this area. The size of the lower opening 44 of the hopper limits the size of articles which may be loaded into the apparatus 1 through the hopper 5.

The material detector 13 in the illustrated appratus 1 is a metal detector operative to determine whether each article is metal and if so, whether it is aluminum. Any type of metal detector which is suitable for performing such determinations could be employed in the apparatus 1. In one such metal detector, a resonant circuit includes an inductor 47 and may include other elements such as capacitors and/or resistors (not shown). The resonant circuit is driven by an oscillator signal having a selected or predetermined frequency. The reactive and resistive impedances of the inductor 47 are varied respectively according to the magnetic permeability and conductivity of any material within the electromagnetic field produced by the inductor when energized. Generally, ferrous metals have the highest permeabilities, and metals have higher permeabilities than non-metals. Also, the relative conductivities of various metals are generally known. The impedance change of the inductor 47 upon the introduction of an article into the field thereof can be measured.

Figure 19:
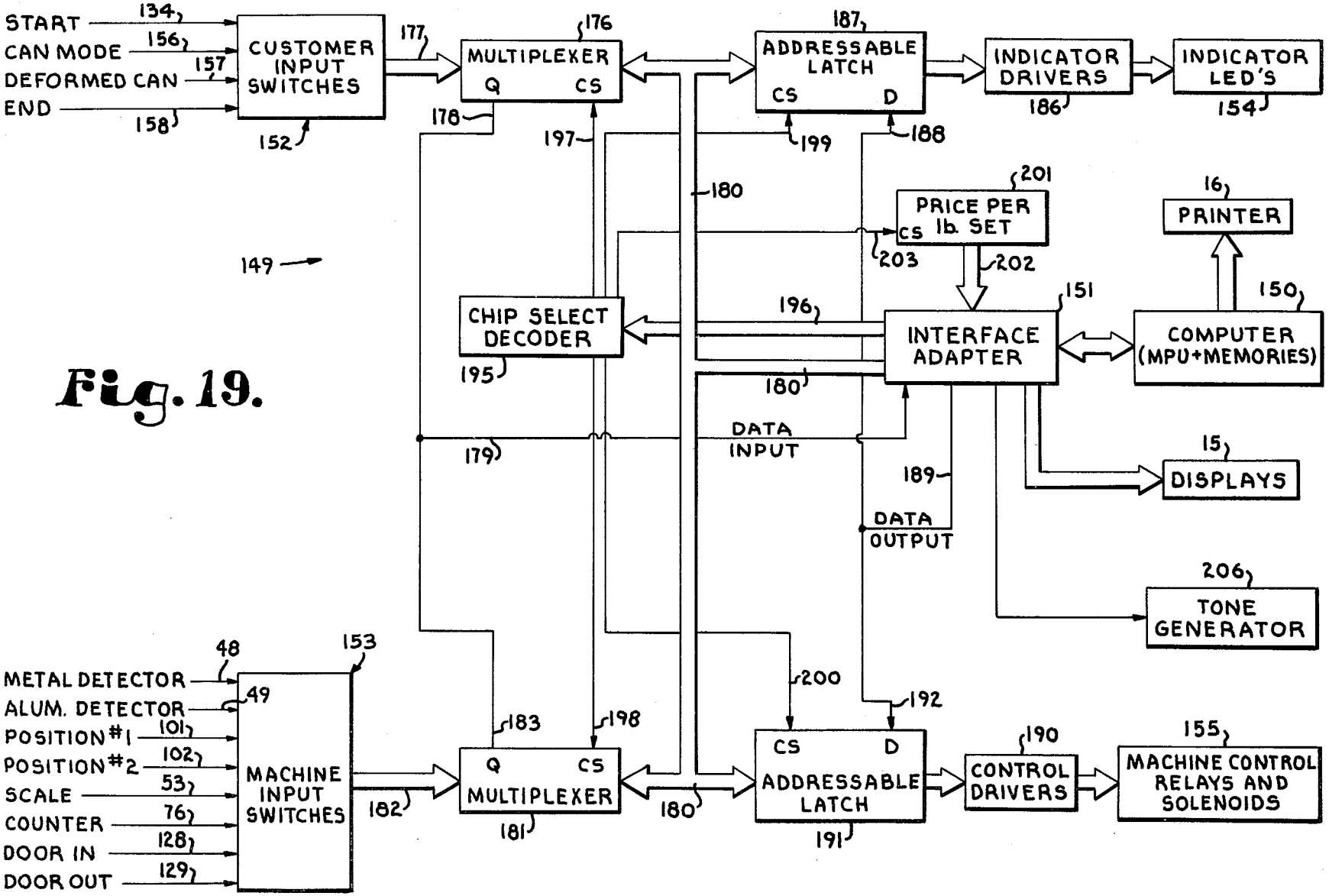
FIG. 19 is a block diagram illustrating the control system of the can sorting apparatus.

The metal detector 13 of the apparatus 1 includes impedance measuring circuitry (not shown) and has two outputs, a "metal" output 48 and an "aluminum" output 49 (FIG. 19). If the tested article causes a selected change in the resistive impedance of the inductor 47, a first selected voltage or logic level is placed on the metal output 48, indicating the presence of metal within the field of the inductor; otherwise a second or complementary logic level is placed on the metal output 48. Similarly, if the tested article causes a change in the reactive impedance of the inductor 47 within a selected range, the first logic level is placed on the aluminum output 49; otherwise the second logic level is placed thereon. In the apparatus 1 as adapted for accepting aluminum cans, only the aluminum output signal is required. However, if the apparatus 1 were adapted for accepting another type of article or several types of articles, the metal output signal would be useful in distinguishing between the types of articles.

Figure 6:
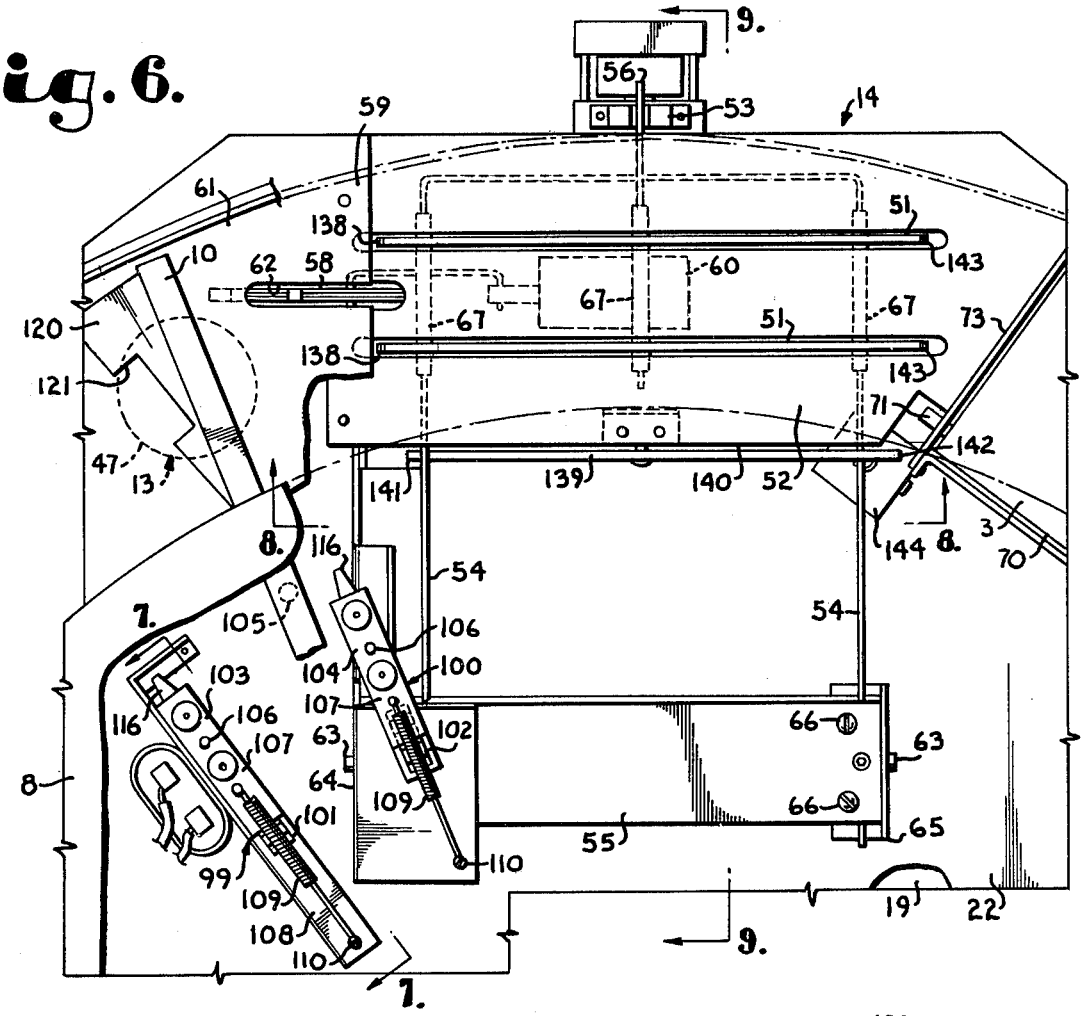
FIG. 6 is an enlarged fragmentary plan type view illustrating details of the scale and position detecting mechanisms of the can sorting apparatus.
Figure 7:
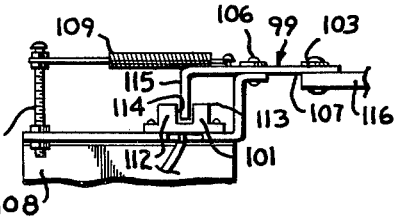
FIG. 7 is a fragmentary elevational view taken on line 7—7 of FIG. 6 and illustrates details of a position detecting switch.
Figure 8:
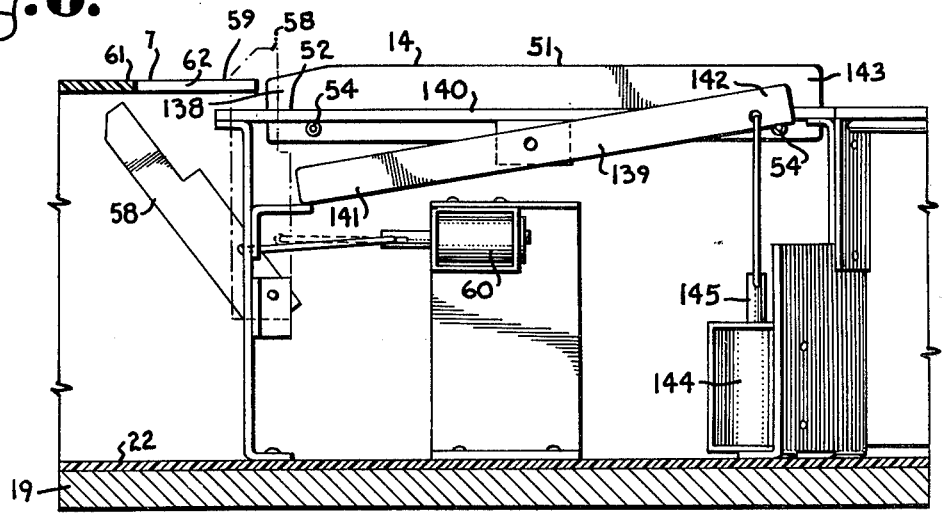
FIG. 8 is an enlarged fragmentary sectional view taken on line 8—8 of FIG. 6 and illustrates a scale back-up mechanism, an article kicker mechanism, and details of the scale of the can sorting apparatus.
Figure 9:
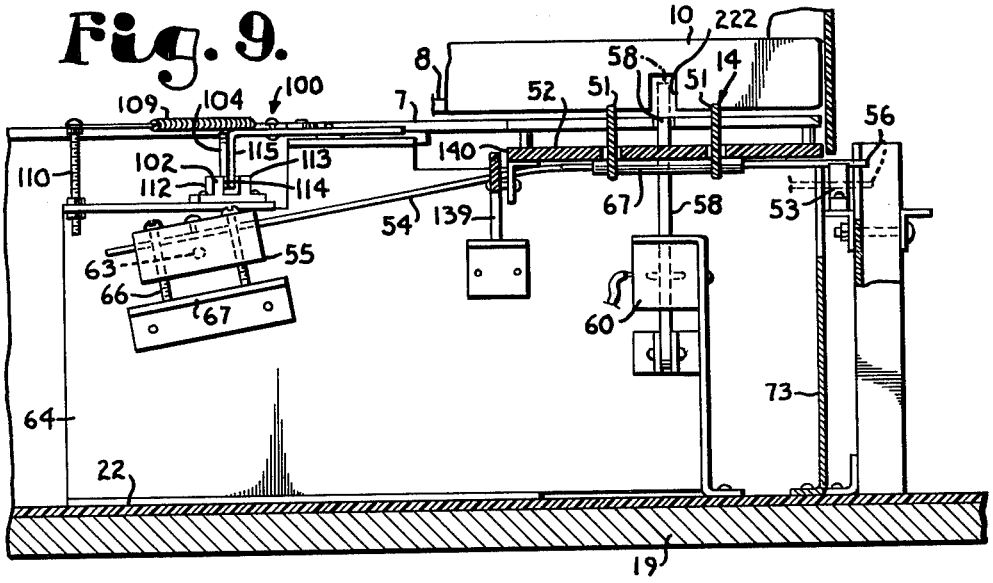
FIG. 9 is an enlarged fragmentary sectional view taken on line 9—9 of FIG. 6 and illustrates further details of the scale mechanism.

Referring to FIGS. 6, 8, and 9, many types of weight scales would be suitable for the scale 14 of the apparatus 1. It is desirable to weigh the cans 2 in order to reject cans to which weight has been added in order to attempt to inflate the reimbursement price of the cans. Structurally, the preferred scale 14 includes a pair of rails 51 projecting above a platform 52 of the scale. The rails 51 are resiliently supported and actuate a scale switch means 53 upon the weighed article exceeding a selected weight. One manner of supporting the rails 51 is by means of a cantilever beam such as the illustrated spring wires 54 extending from a support block 55. This manner of supporting the rails 51 avoids the use of pivots which would likely become contaminated with syrup from the beverage cans thereby resulting in unreliable weight determinations. The illustrated scale switch 53 is a photoswitch or LED/phototransistor pair wherein a projection 56 connected to the rails 51 interrupts the light beam of the photoswitch 53 for an overweight article. Interruption of the light beam of the photoswitch 53 provides a voltage level change in the transistor portion of the switch 53, thereby providing a weight signal which can be monitored. The illustrated scale 14, therefore, does not actually determine the weight of each article but instead determines whether or not the weight of each article exceeds a selected weight. This is a sufficient determination for the apparatus 1 as applied to sorting cans 2. However, if the apparatus 1 were intended for sorting other types of articles, a more quantitative weight determination might be necessary.

The apparatus 1 is preferably provided with means to advance each can 2 ahead of the respective pusher arm 10 conveying same so that the can may be weighed without contact by the arm 10. Beverage cans are often sticky, and should a can 2 adhere to its pusher arm 10, an inaccurate weight determination would result. The illustrated can kicker arm 58 is pivotally supported at the exit end 59 of the metal detector 13. The kicker arm 58 is actuated by means of a kicker solenoid 60 attached to the arm. The arm 58, in an up position, projects above the surface of the metal detector segment 61 of the surface 7 through a slot 62 therein and is retracted below the surface 7 in a down position thereof. The kicker solenoid 60 is activated just as a trailing end of a can reaches the exit end 59 of the metal detector 13.

The scale support block 55 is pivotally mounted at opposite ends thereof by means such as pivot screws 63 passing through brackets 64 and 65 which are mounted on the lower plate 22 of the subassembly unit 21. The block 55 is preferably provided with means for calibration or adjustment of the scale 14, such as adjusting screws 66 which engage flanges 67 extending respectively from the brackets 64 and 65. The calibration screws 66 may be adjusted such that a selected deflection of the scale rails 51 is required in order for the projection 56 to actuate the scale switch 53. Alternatively, the screws 66 may be adjusted in order to preload the spring arms 54 in such a manner that a selected force on the rails 51 is required before deflection thereof begins to occur. The scale 14 is preferably constructed in an open manner to prevent the collection of beverage syrups in portions thereof. In the illustrated scale 14, the rails 51 are interconnected by means of sleeves 67 through which the spring arms 55 are received. Another sleeve 67 is positioned centrally of the rails 51 and provides a mount for the projection 56 which operates the scale switch 53.

Figure 10:
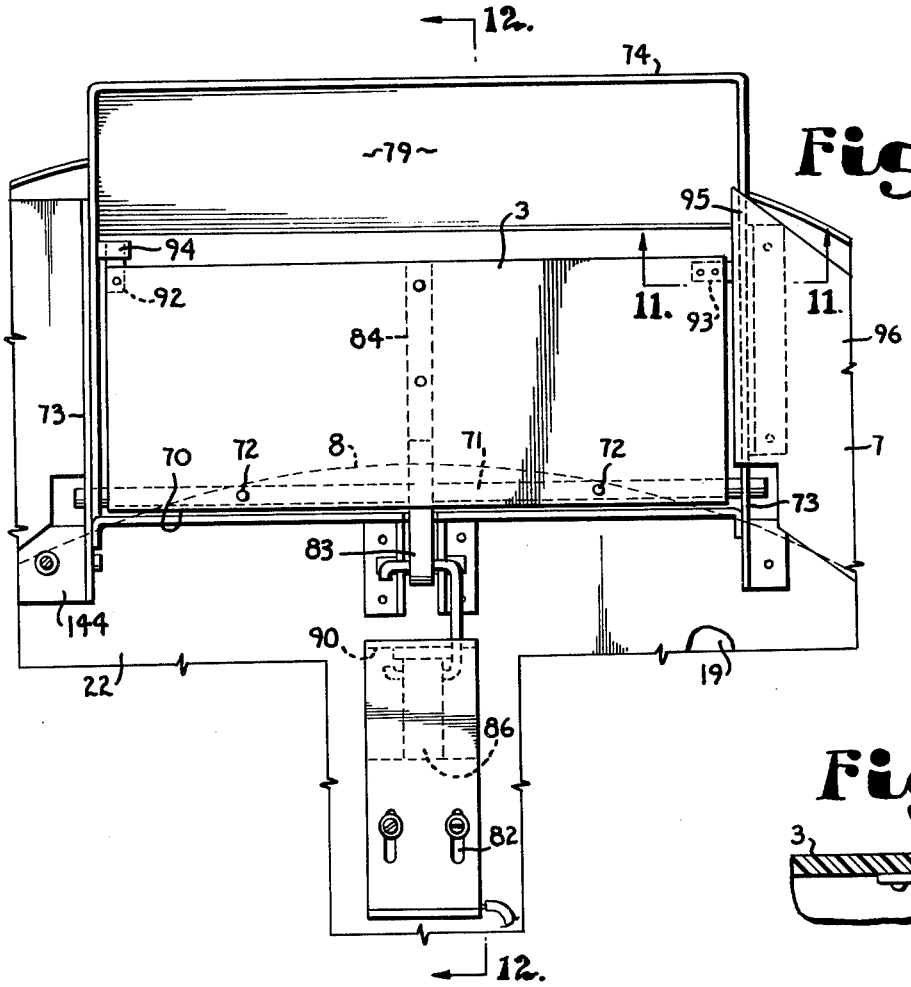
FIG. 10 is a view similar to FIG. 6 and illustrates details of an accept door of the can sorting apparatus.
Figure 11:
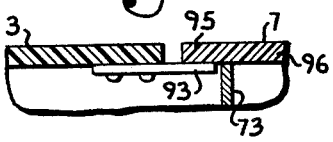
FIG. 11 is an enlarged sectional view taken on line 11—11 of FIG. 10 and illustrates a door overshoot stop feature of the accept door.
Figure 15:
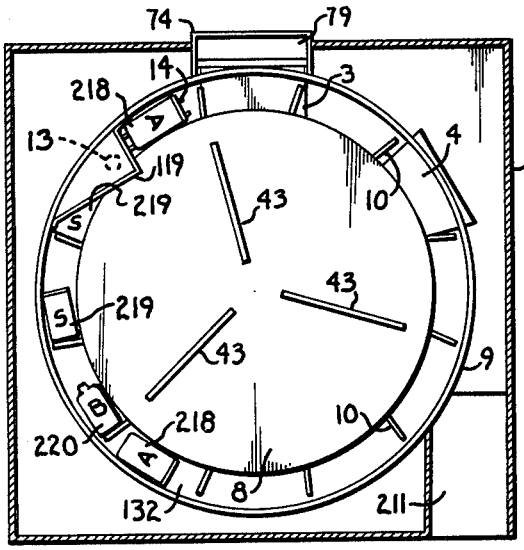

The accept door 3 and reject door 4 are constructed in a similar manner. Each forms a respective segment of the can conveying surface 7. Referring to FIGS. 10, 11, and 12, the accept door 3, for example, is hinged at its radially inward edge 70 by means such as a hinge rod 71 extending along the inner edge 70 and attached to the door 3 by screws or rivets 72. The ends of the rod 71 are received in apertures in the end walls of an accept chute 74. The accept chute channels the received articles 2 to an accept location or receptacle, such as a cart 75. The accept chute 74 may be provided with an accept counter 76, such as a light emitter 77 and light sensor 78, to confirm the passage of an article 2 therethrough. The chute 74 may include a baffle 79 therein to direct a received article therethrough.

The accept door 3 may be opened and closed by means such as an accept door solenoid 82 connected to a cam member 83 which is positioned for engagement with a cam follower or ramp member 84 mounted on a lower side of the accept door 3. The cam member 83 is pivotally mounted at a lower end 85 thereof and has the plunger 86 of the solenoid 82 connected thereto at a position above the pivot pin 87 thereof. The cam 83 has a cam surface 88 which cooperates with a cam follower surface 89 on the ramp member 84. The solenoid 82 may be a single acting solenoid with spring return. The illustrated solenoid 82 is a normally extended solenoid which retracts upon being energized. The solenoid may include an internal compression spring (not shown) for extending the plunger 86 upon de-energizing the solenoid; alternatively, a rotary acting spring (not shown) may be associated with the cam 83 and positioned about the pivot pin 87 thereof. The accept door 3 is normally in a closed position or in the plane of the article supporting surface 7. Upon retraction of the solenoid 82, the cam 83 is pivoted out from under the door 3 whereby the door opens to allow an article 2 to fall through the accept chute 74. Upon extension of the solenoid 82, the cam 83 is pivoted into engagement with the cam follower surface 89 thereby swinging the door 3 back into the closed position. In a similar manner, the reject door 4 82 operated by a reject door solenoid 91.

The solenoid 82 may be provided with an adjustable stop member 90 to limit the length of the return stroke of the plunger 86 thereof. The accept door 3 is also preferably provided with positive stops to prevent same from being pivoted above the level of the article conveying surface 7. The illustrated door 3 is provided with one or more stop tabs 92 and 93 positioned for engagement with stationary stop means on the apparatus 1. As shown in FIGS. 10 and 12, the stop tab 92 is positioned for engagement with a stop bracket 94 attached to a side wall 73 of the accept chute 74. As shown in FIGS. 10 and 11, the stop tab 93 is positioned for engagement with an edge portion 95 of a segment 96 of the article conveying surface 7 which overlaps a wall 73 of the accept chute 74 which is adjacent to the stop tab 93. Only one accept door 3 has been described and illustrated since the preferred embodiment of the apparatus 1 is adapted to accept only aluminum cans. However, if the apparatus were adapted to accept several types of articles, the apparatus could be provided with an accept door for each type of article.

The metal detector 13 preferably operates continuously as long as power is applied to the apparatus 1. However, it is only necessary to read the output signals from the detector 13 as an article 2 actually passes through the field of the inductor 47. In order to signal that an article is in position in the field, the apparatus 1 is provided with a pair of position detectors 99 and 100. The first and second position detectors 99 and 100 have respective first and second position detector switches 101 and 102 associated therewith. The illustrated position detectors include respective resiliently pivotable switch operator members 103 and 104 which are engaged by a depending projection 105 from each pusher arm 10 as the article conveying wheel 8 rotates. Each of the illustrated switch operators 103 and 104 is constructed as an L-shaped member which has a pivot pin 106 through a longer leg 107 thereof to pivotally connect same to a mounting bracket. The first operator 103 is mounted on a bracket 108, while the second operator 104 is mounted on the bracket 64. A tension spring 109 has one end connected to the leg 107 and the other end connected to a post 110 attached to the respective bracket 108 or 64.

The illustrated position detector switches 101 and 102 may be photoswitches similar to the scale switch 53. Each includes a light source, such as a light emitting diode (LED), on one side 112 thereof and a light sensor, such as a phototransistor, on the other side 113 thereof with a gap 114 therebetween. The transistor is normally biased into conduction by the light from the LED. Upon the passage of an opaque object through the gap 114, the transistor is turned off because of the lack of biasing light therefor. The switch operators 103 and 104 each include a shorter leg 115 which is normally positioned in the gap 114 of the respective switch by the spring 109 thereby turning off the respective transistors of the switches 101 and 102. Upon the engagement of the projection 105 with a contact lug 116 positioned on the free end of the longer leg 107 of each operator, the respective shorter leg 115 is resiliently and momentarily pivoted out of the gap 114 whereby the transistor is turned on to provide a position signal. As the projection 105 engages the first position detector 99, a first position signal is generated, signifying the possible presence of an article 2 whereby the signals from the metal detector 13 may be read. As the projection 105 engages the second position detector 100, reading of the metal detector signals is terminated. The position signals from the first and second position detector switches 101 and 102 may be monitored to determine whether or not the article conveying wheel 8 is rotating at the desired speed. Thus, the absence of the position signals over a selected period of time signifies that the apparatus 1 is jammed whereby unjamming procedures may be initiated.

During normal article processing, the non-deformed cans 2 are conveyed one at a time to the metal detector 13, scale 14, and the doors 3 and 4. Because of the manner in which the apparatus 1 is loaded, that is, a plurality of cans 2 being dumped into the lower portion 12 of the chamber 6 and because the cans are often sticky, it is possible for more than one can to be lifted out of the pile between two consecutive pusher arms 10 by the wheel 8. In order to ensure that only one article at a time is processed, the apparatus 1 is provided with an article diverter 119 extending inwardly from the article retaining wall 9 in spaced relation to the article supporting surfaces 7 and in covering relation to the metal detector 13. Should more than one non-deformed can 2 be positioned between a pair of successive pusher arms 10, engagement of the extra cans with the diverter 119 will cause the extra cans to be dislodged, the extras then falling back to the lower portion 12 of the processing chamber 6. Further, each pusher arm 10 may be provided with a spacer web 120 in order to define a space between successive pusher arms 10 for the largest size article desired to be processed. The web 120 may be contoured to accommodate the shape of the type of article 2 to be processed. For example, the webs could have a notch 121 to receive the top end of a bottle if bottles were to be the principal article to be processed.

When non-deformed cans are processed, it is possible for cans which have been flattened in the middle to slide partially out through the space between the lower edge 26 of the wall 9 and the outer perimeter 27 of the article conveying surfaces 7. In order to lessen the possibility of such a can becoming wedged and halting rotation of the wheel 8, the apparatus 1 may be provided with means such as a guide or plow 123 in the area of the article diverter 119. The plow 123 may be an extension of the metal detector segment 61 of the can supporting surfaces 7. The plow 123 is shaped to engage an overhanging portion of the can and in cooperation with the wheel 8 to guide same out of the processing chamber 6 through a cut-out 124 formed in the wall 9 in the area of the article diverter 119 for ejection by gravity through a trash chute 125 (FIG. 1) out of the apparatus 1.

The apparatus 1 is preferably adapted for processing deformed cans in addition to non-deformed cans. For this purpose, the apparatus 1 is provided with the deformed can door 30 to selectively close the gap 29 between the article retaining wall 9 and the surface 7 on the left side of the apparatus as viewed in FIGS. 4 and 13. The illustrated door 30 has hinge brackets 126 attached thereto by means of which pivot fasteners 127 connect the door 30 to the L-shaped brackets 25 on the left side of the apparatus 1. In order to monitor the position of the door, the apparatus 1 is provided with a "door-in" sensor switch 128 to sense the closure of the door 30 and a "door-out" switch 129 to sense that the door is open. While the door 30 may be opened and closed by some sort of a motor, the illustrated door 30 is moved manually and is provided with a handle 130 for this purpose. In order to retain the door in the open position, means such as a magnet 131 is mounted on the wall 9 for engagement by one or both of the hinge brackets 126. A similar arrangement or a latch (not shown) may be provided for retaining the door 30 in the closed position thereof.

While it would be possible to process the deformed cans by loading a plurality of same into the hopper 5, fewer jamming problems are experienced by loading the deformed cans one at a time into the lower portion 12 of the processing chamber 6, preferably in the lower left hand quadrant 132 (as viewed in FIG. 4) of the article conveying surface 7. By loading at this location, there is less possibility of the deformed cans 28 being urged by gravity and by the wheel 8 out of the apparatus through the gap 29 between the wall 9 and the article conveying surface 7. In the non-deformed can mode, the apparatus 1 operates substantially continuously. However, in the deformed can mode, the wheel 8 is stationary as each can is loaded. Then a start button 134 (FIG. 19) is pressed to advance the deformed can 28 to the metal detector 13, scale 14, and to a position just past accept door 3. If the article is acceptable, it is received through the accept door 3 as the article is brought into position over the accept door. Otherwise, the unacceptable article is deposited through the reject door 4 on passing thereover during the next deformed can mode cycle. The single cycling in the deformed can mode is safer for the operator since no parts of the machine are moving as each deformed can is loaded. Further, if jamming should occur, corrective measures are easier to make with only one article in the machine and with the parts thereof stationary.

In spite of design precautions to prevent jamming, it is still possible for the apparatus 1 to become jammed occasionally because of the nature of the articles processed. The apparatus 1 is adapted to determine if the wheel 8 is rotating by monitoring the position switches 101 and 102. During operation if no position signals are generated within a selected time period, it is determined that the wheel 8 is not rotating, presumably because an article has become wedged in such a manner as to prevent rotation. The apparatus 1 is adapted to execute an unjamming procedure in an attempt to dislodge the wedged article. For this procedure, the direction of rotation of the motor 11 is reversed for a short period of time to thereby reverse the rotation of the article conveying wheel 8. In most cases, this would be enough to free the wedged article. The apparatus 1 is also preferably provided with means such as one or more unjamming solenoids 136. One location where it is foreseen that jamming might occur is in the area of the article diverter 119. Therefore, an unjamming solenoid 136 is positioned in this area for operation in a direction perpendicular to the article supporting surface 7. The solenoid 136 is positioned generally below the surface 7 and is extended therethrough upon actuation and is resiliently retracted. The combination of reversal of the wheel 8 in addition to the punching action of the solenoid 136 should be sufficient to free an article which has become wedged under the diverter 119.

Should an article 2 be present on the rails 51 of the scale 14 when reversal of the wheel 8 occurs, it is probable that the article would be caught on the edge of the exit end 59 of the metal detector segment 61 of the article supporting surface 7, thereby preventing reversed rotation of the wheel 8. In order to prevent this occurrence, means are provided to tilt the rear ends 138 of the rails 51 above the level of the surface 7. In this way, the rails 51 act as a ramp so that the backward moving article does not encounter the edge 59 of the segment 61. Referring to FIGS. 6, 8, and 9, a scale back-up lever 139 is pivotally connected to an inward edge 140 of the scale platform 52. A rear end 141 of the lever 139 is positioned under the spring wire 54 at the rear ends 138 of the rails 51, and a front end 142 of the lever is positioned over the spring wire 54 at the front ends 143 of the rails 51. An extendible motor, such as a scale back-up solenoid 144, is connected to the front end 142 of the lever 139 and is positioned for operation substantially perpendicular to the scale platform 52. Whenever the direction of rotation of the wheel 8 is reversed, the solenoid 144 is retracted whereby the lever 139 is pivoted in a clockwise direction (as viewed in FIG. 8) to lift the rear ends 138 and lower the front ends 143 of the rails 51. Upon deactuation of the solenoid 144, the plunger 145 thereof is resiliently extended to return the rails 51 to their normal position substantially parallel to the scale platform 52.

Because of the number of functions which must be monitored and controlled and the complex timing and sequencing requirements involved for operation of the apparatus 1, the apparatus is preferably connected to and controlled by a control system 149 including a computer 150. The computer 150 is preferably a general purpose type of digital computer which includes a microprocessor, memories, support circuitry, and the like. There are a number of ways in which the computer 150 could be applied to the apparatus 1. As illustrated in FIG. 19, each individual monitored and controlled function is addressable, and the monitored signal or control signal takes the form of one bit of data respectively input to or output from the computer 150. Addressing and data input/output are accomplished by means of an interface adapter 151, such as a type known as a versatile interface adapter or VIA, connected between the computer 150 and the apparatus 1.

The monitored functions include customer input switches 152 and machine input switches 153. The controlled functions include indicator lights or LED's 154, and the machine control relays and solenoids 155. The input switches 152 and 153 may take the form of mechanical switches or photoswitches, such as the previously described photoswitch 53 of the scale 14. The customer input switches 152 include the start switch 134, a non-deformed can mode selection switch 156, a deformed can mode selection switch 152, and an end switch 158. The machine input switches 153 include the first and second position detector switches 101 and 102, the door-in detector switch 128, the door-out detector switch 129, and the scale switch 53. The accept door 3 may include the counter switch 76 which is operated each time an article passes through the accept chute 74. As described above, the metal detector 13 includes the metal detector output 48 and the aluminum detector output 49 providing respectively a metal detector output signal and an aluminum detector output signal.

Figure 20:
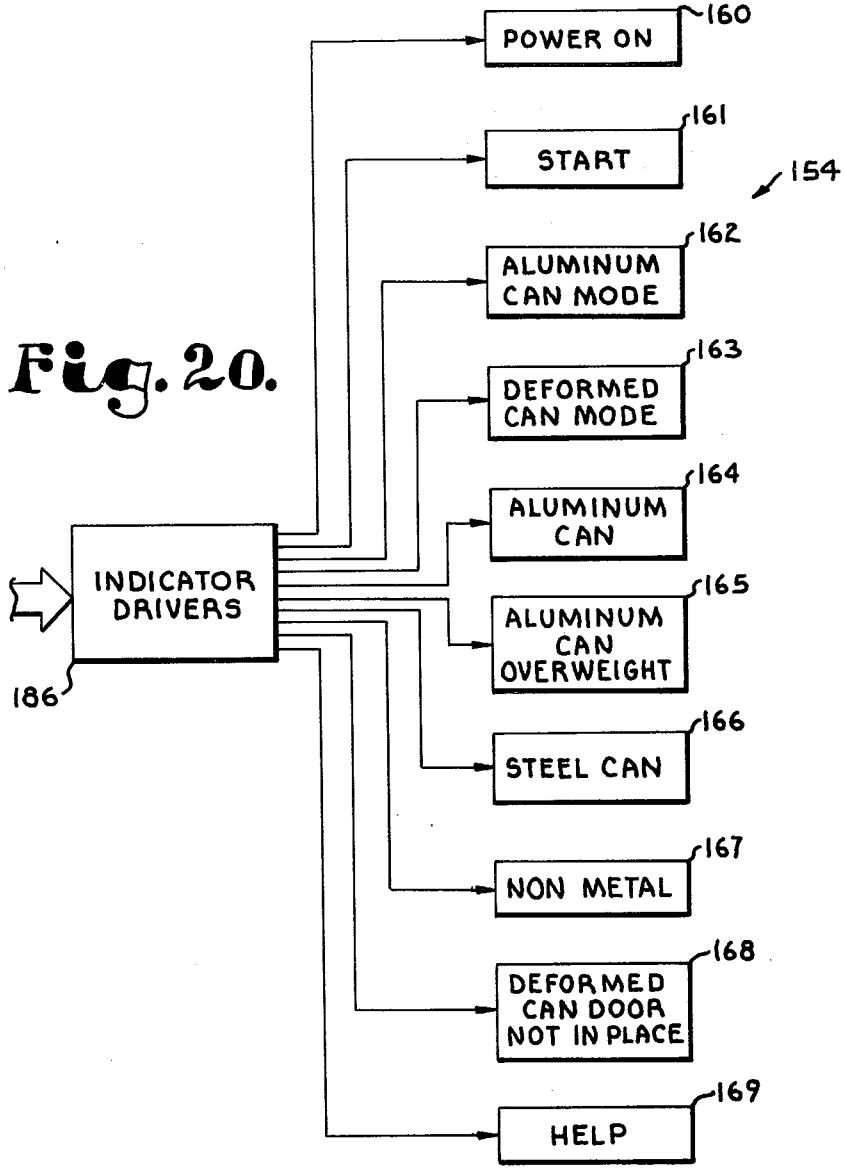
FIG. 20 is a block diagram illustrating the visual indicators of the control system.

Referring to FIG. 20, the indicator lights or LED's 154 include a power-on indicator 160, a start indicator 161, a non-deformed aluminum can mode indicator 162, a deformed can mode indicator 163, an aluminum can indicator 164, an aluminum can overweight indicator 165, a non-aluminum or steel can indicator 166, a non-metal indicator 167, a deformed can door-not-in-place indicator 168, and a "help" indicator 169. The power-on indicator 160 is lit whenever power is applied to the apparatus 1. The start indicator 161 is lit whenever the start switch 134 has been pressed to activate the apparatus 1. One or the other of the mode indicators 162 or 163 is lit whenever the corresponding mode switch 156 or 157 has been selected. The indicators 164, 165, 166, and 167 are provided to advise the customer of the results of processing each article through the apparatus 1. If the acceptable articles are aluminum cans of a selected weight, the lighting of the aluminum can indicator 164 indicates that an acceptable weight aluminum can has been detected and is, therefore, accepted through the accept chute 74. The indicator 165 shows that an aluminum can was detected but that the can was overweight. The indicator 166 shows that a metal article, such as a steel or tin can, was detected and is not acceptable. The indicator 167 is lit to show that a non-metal article was detected. The indicator 168 is lit to show that the deformed can door 30 is not detected to be in the proper position for the operating mode which has been selected with the mode switches 156 and 157. For example, if the non-deformed can mode switch 156 has been operated and the door 30 is in the closed position, the indicator 168 would be lit, and the apparatus 1 would not function until the door 30 was opened far enough to operate the door-out switch 129. Conversely, if the deformed can mode switch 157 is operated, lighting of the indicator 168 would indicate that the door 30 is in the open position. The help indicator 169 is lit whenever the apparatus 1 has attempted to execute an unjamming procedure unsuccessfully for a selected number of times. Upon such an occurrence, the apparatus 1 automatically shuts down to prevent damage to the components thereof, and the help indicator 169 is illuminated. Whenever either of the indicators 168 or 169 is activated, the apparatus 1 becomes or remains inoperative until respectively the door 30 has been put in the proper position or the apparatus has been cleared.

Figure 21:
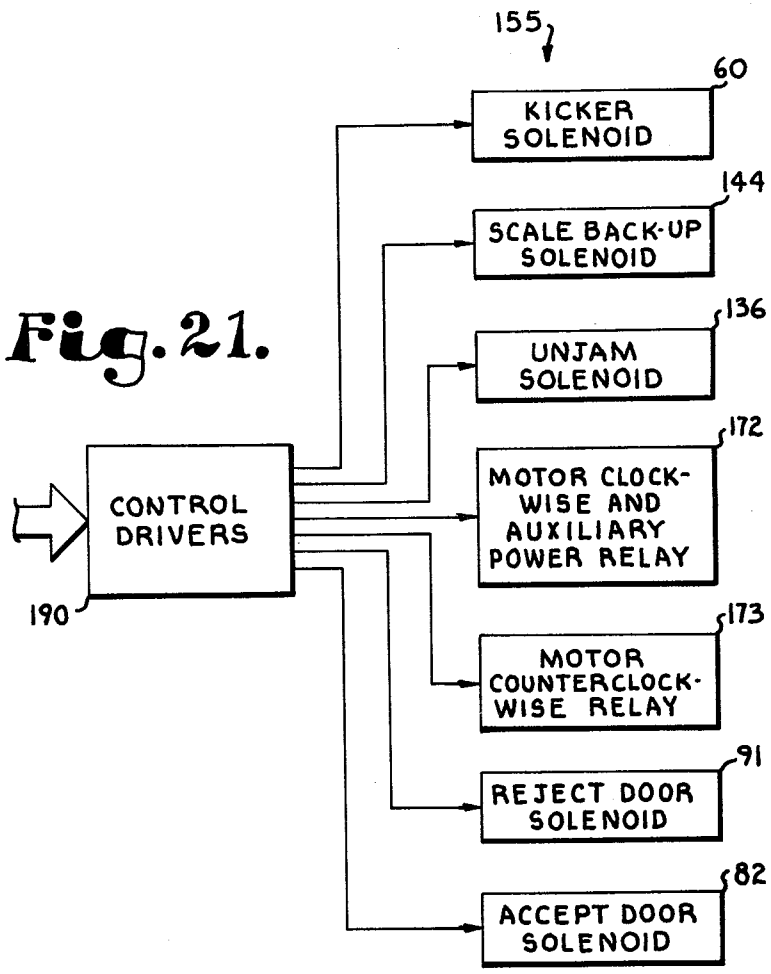
FIG. 21 is a block diagram illustrating the solenoid and relays of the control system of the can sorting apparatus.

Referring to FIG. 21, the control relays and solenoids 155 include the kicker solenoid 60, the scale back-up solenoid 144, the unjam solenoid 136, a motor clockwise and auxiliary power relay 172, a motor counterclockwise relay 173, the reject door solenoid 91, and the accept door solenoid 82. The clockwise relay 172 is actuated whenever the start button 134 is pressed to cause the motor 11 to rotate the article conveying wheel 8 in a clockwise direction as viewed in FIG. 4. The counterclockwise relay 173 is actuated during the unjamming procedure in order to cause the wheel 8 to be rotated in a counterclockwise direction as viewed in FIG. 4.

The customer input switches 152 are addressed by means of a first multiplexer 176. The multiplexer 176 has a plurality of inputs which are connected to the individual customer input switches 152 by means of a first multiplexer input bus 177, and a single data output 178 (labeled Q in FIG. 19) is provided for data input to the interface adapter 151 by way of a data input line 179. The multiplexer 176 is operative to select a particular input for transfer of the signal thereon to the output 178 according to the binary word or address which is received on an address bus 180. In a similar manner, a second multiplexer 181 has a plurality of inputs connected to the individual machine input switches 153 by means of a second multiplexer input bus 182 and has a single output 183 connected to the data input line 179. The second multiplexer 181 is connected to the address bus 180 for selection of the desired input signal from the machine input switches 153 for transfer to the output 183 of the multiplexer 181.

The indicator LED's 154 are connected through respective indicator drivers or amplifiers 186 to the individual output terminals of a first addressable latch 187 having a single data input 188 (labeled D in FIG. 19) connected by way of a data output line 189 from the interface adapter 151. In a similar manner, the individual control relays and solenoids 155 are connected through respective control drivers or amplifiers 190 to the individual outputs of a second addressable latch 191 having a single data input 192 connected to the data output line 189. The addressable latches 187 and 191 operate substantially in an inverse manner to the first and second multiplexers 176 and 181. The latches 187 and 191 are connected to the address bus 180 for selection of the particular indicator 154 or relay/solenoid 155 for the routing of indicator or control signals from the computer 150 through the interface 151 and the date output line 189.

In order to select the multiplexer or latch to which data is to be read from or written to, a chip select decoder 195 is provided and is connected by means of a chip select address bus 196 to the interface adapter 151. The decoder 195 has a plurality of outputs connected to chip select (CS) terminals 197, 198, 199, and 200 respectively of the first and second multiplexers 176 and 181 and the first and second addressable latches 187 and 191. Depending upon the binary word received on the chip select bus 196, the decoder 195 selects one of the multiplexers or latches for activation. Thus, a combination of two binary words or addresses, one from the bus 180 and another from the bus 196, must be output from the interface adapter 151 in order to read from or write to any individual input switch, indicator, or control function.

Since the salvage price of aluminum and other materials fluctuates and since the apparatus 1 is adapted to read out a monetary reimbursement amount, provisions must be made for entering the current value of the recycled material into the apparatus. In the illustrated apparatus 1, thumbwheel switches 201 are provided for setting the reimbursement price per pound of aluminum. Preferably, the switches 201 are positioned on the apparatus at a location which is inaccessible to the customers, such as behind a locked panel (not shown). The thumbwheel switches communicate with the interface adapter 151 over a price set bus 202. The switches 201 have a chip select terminal 203 which communicates with one of the chip select lines of the chip select decoder 195. Upon activation of the line connected to the terminal 203, the price per unit weight may be read by the computer 150 through the interface adapter 151. Alternatively, the reimbursement price per unit weight or price per article could be set by other means such as a keypad and a set of electronic latches (not shown).

The displays 15 are preferably numeric display devices such as seven segment LED's or liquid crystal displays (LCD's). The displays 15, customer input switches 152, and indicator LED's 154, are preferably positioned on an operation panel 205 (FIG. 1) which is located in a prominent location on the apparatus 1. The apparatus 1 may be provided with an audible tone generator 206. The illustrated tone generator 206 is connected to the interface adapter 151 and is so adapted that different tones are generated in response respectively to the activation of selected ones of the indicator LED's 154 to allow monitoring of the operation of the apparatus 1 by personnel in the establishment in which the apparatus is installed while performing other duties. Preferably, the door-not-in-place indicator 168 and help indicator 169 flash on and off upon activation thereof. Further, the tones associated with the indicators 168 and 169 are pulsed on and off until the condition activating same has been corrected. This is to positively alert the customer and store personnel that a condition needs to be corrected for continued operation of the apparatus 1. The printer 16 may be connected directly to and actuated by the computer 150.

When all of the articles have been processed in one of the undeformed can mode or deformed can mode, the end button 158 is pressed which halts the rotation of the article conveying wheel 8 and causes the computer 150 to tally the count of articles and to compute a reimbursement amount based upon the price which has been set on the thumbwheel switches 201. The reimbursement amount is then printed on a tape or ticket 207 (FIG. 1) which the customer may then submit to a clerk in the store in which the apparatus 1 is located for reimbursement or for credit against current purchases.

Figure 2:
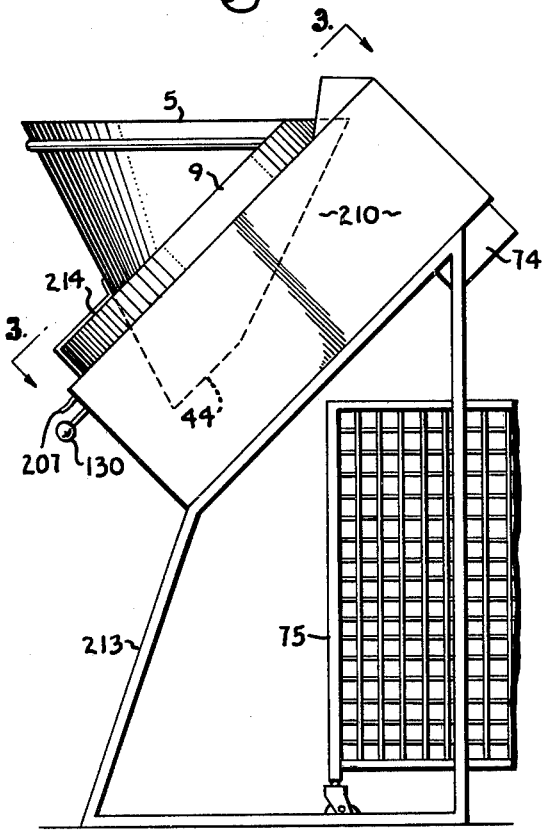
FIG. 2 is a side elevational view of the can sorting apparatus.
Figure 3:
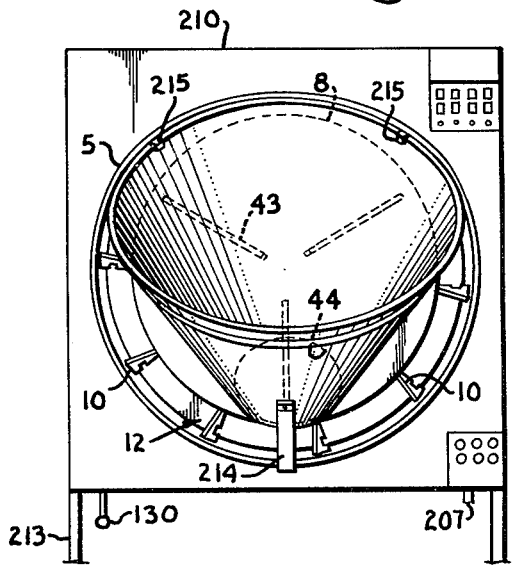
FIG. 3 is a tilted plan view of the can sorting apparatus taken on line 3—3 of FIG. 2.

Referring to FIGS. 1, 2, and 3, the apparatus 1 is preferably enclosed in a protective housing or shroud 210. The housing 210 has openings therein defining the trash chute 124 and a reject chute 211. A receptacle such as a basket (not shown) may be positioned in front of the reject chute 211 to collect rejected articles. Further, a slot 212 is provided for the deformed can door handle to extend through for operation of the deformed can door 30. The apparatus 1 is mounted in a tilted position on a stand 213 which provides sufficient space below the apparatus 1 for positioning the accepted article cart 75 below the accept chute 74. The hopper or holding receptacle 5 may be mounted as by means of one or more brackets 214 extending upwardly from the wall supporting band 24. The hopper 5 may be further braced by means of fasteners 215 connected thereto and to the article retaining wall 9. Means such as a trough 216 may be provided on the housing 210 to catch small articles which are discharged through the trash chute 125 and to collect liquids such as beverage residue which may be in the cans which are processed.

Figure 16:
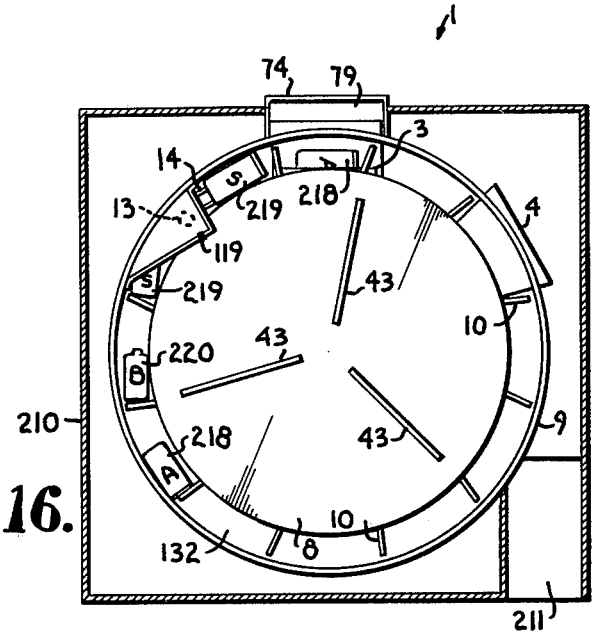
Figure 17:
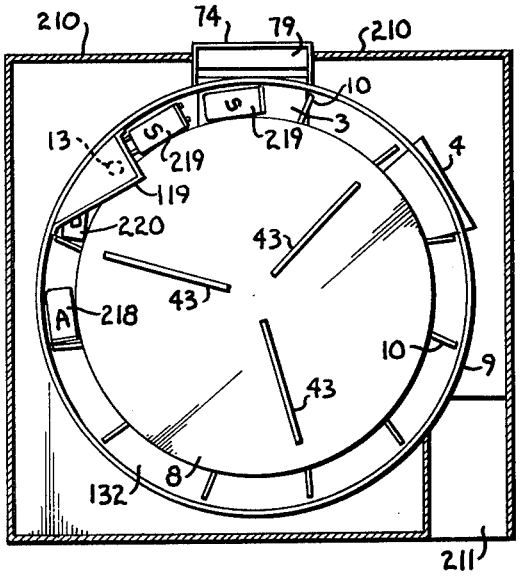
Figure 18:
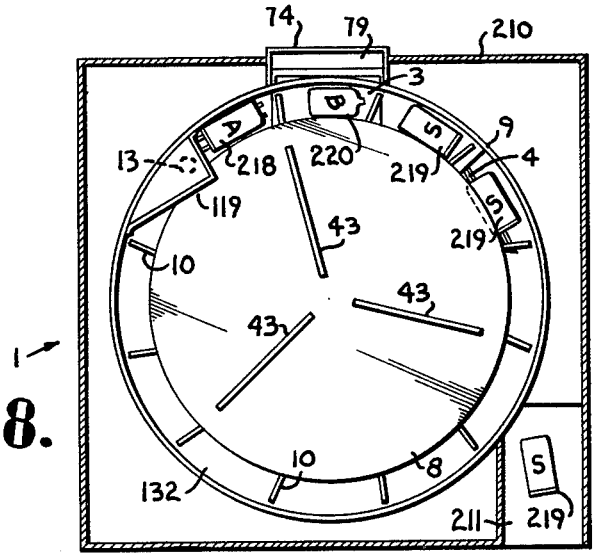

FIGS. 14 through 18 diagrammatically illustrate the operation of the apparatus 1. These figures illustrate the processing of a plurality of types of articles including aluminum cans 218 (labeled A), steel cans 219 (labeled S), and glass or plastic bottles 220 (labeled B). A plurality of the articles 2 is dumped into the hopper 5. Upon actuation of the start button 134 and the non-deformed can mode button 156 and assuming that the deformed can door 30 is in the proper position, the article conveying wheel 8 begins to rotate in a clockwise direction as viewed in the figures thereby gathering up the articles 2, preferably one at a time. As shown in FIG. 14, should more than one article attempt to occupy the space between two successive pusher arms 10, engagement of the uppermost article with the article diverter 119 will cause the extra article to be deflected back into the pile of articles in the lower portion 12 of the processing chamber 6. The articles are conveyed past the metal detector 13 and thereafter to the scale 14. As each article reaches the end 59 of the metal detector 13, the article kicker 58 is actuated to advance the article ahead of its respective pusher arm 10 so that weighing can occur without the influence of the pusher arm. The pusher arm 10 is preferably provided with a notch 222 for clearance of the arm 10 past the kicker 58. According to the signals generated by the metal detector 13 and scale 14, the computer 150 determines whether or not the current article is acceptable. As shown in the figures, the first article in the line of articles is an aluminum can 218. Assuming that the aluminum can 218 is not overweight, the accept door 3 will be opened to receive the can 218, as is shown in FIG. 16. The next articles in the line are two steel cans 219 and a bottle 220. Regardless of whether the steel cans 219 and bottle 220 are of the correct weight, the steel cans and bottle will be rejected because of the signals generated by the metal detector 13. This is illustrated in FIG. 18 wherein a steel can 219 is being received through the reject door 4 for ejection through the reject chute 211. Similarly, the bottles 220 will be rejected.

When the non-deformed cans have been processed, the handle 130 is manipulated to close the deformed can door 30, and the deformed can mode button 157 is pressed. In the deformed can mode, the apparatus 1 processes the articles one at a time. Therefore, a deformed can is loaded into the lower portion 12 of the processing chamber 6 in the area of the lower left hand quadrant 132 of the article supporting surface 7. The start button 134 is pressed, and the deformed can is conveyed toward the metal detector 13 and the scale 14. Upon the determinations made at these stations, the deformed article is then conveyed to the accept door 3 or reject door 4. If the article is accepted, the accept door 3 is opened to receive the deformed can through the accept chute 74, and the wheel 8 is halted at a selected position. However, if the deformed can is either non-aluminum or overweight, it is conveyed to the reject door 4 for ejection through the reject chute 211 on the next cycle. Each subsequent deformed can is processed one at a time in the same manner.

It is to be understood that while certain forms of the present invention have been illustrated and described herein, it is not to be limited to the specific forms or arrangement of parts described and shown.

What is claimed and desired to secure by Letters Patent is as follows:

1. A method of sorting articles comprising the steps of:
(a) generating a material signal indicative of the material of each article;
(b) generating a weight signal indicative of the weight of each article;
(c) in the absence of one of a selected material signal and a selected weight signal for an article, discharging said article to a reject location;
(d) in response to the combination of said selected material signal and said selected weight signal for an article, discharging said article to an accept location; and
(e) counting the number of the accepted articles which are discharged to said accept location.

2. A method as set forth in claim 1 including the steps
(a) calculating a reimbursement price based in part on the count of said accepted articles; and
(b) printing said reimbursement price on a ticket.

3. A method as set forth in claim 1 wherein said selected material signal is generated for an article upon said article being formed of aluminum.

4. A method as set forth in claim 1 wherein:
(a) said articles include deformed aluminum cans; and
(b) said selected material signal is generated for each deformed aluminum can.

5. A method as set forth in claim 1 wherein said material signal is generated by the steps of:
(a) generating an electrical signal having a predetermined frequency;
(b) applying said electrical signal to a resonant circuit including at least an inductor;
(c) positioning an article within an electromagnetic field produced by said inductor whereby the impedance of said inductor when driven by said electrical signal at said predetermined frequency is varied in response to the magnetic permeability and conductivity of the material of said article;
(d) measuring the impedence change of said inductor;
(e) in response to a change in the reactive impedance of said inductor within a selected range, generating said selected material signal having a first voltage level; and
(f) in response to a change in said reactive impedance other than within said selected range thereof, generating said material signal having a second voltage level.

6. A method as set forth in claim 5 including the steps
(a) in response to a change in the resistive impedance of said inductor within a selected range, generating a second material signal having said first voltage level; and
(b) in response to a change in said resistive impedance other than within said selected range thereof, generating said second material signal having said second voltage level.

7. A method as set forth in claim 1 wherein said selected weight signal is generated for an article upon said article weighing not more than a selected weight.

8. A method of sorting articles comprising the steps of:
(a) receiving in an article feed receptacle a plurality of randomly oriented articles having sizes within a selected range of sizes;
(b) feeding said plurality of articles to a singulating conveyor means operative to convey a stream of said articles one at a time;
(c) conveying each article to a material detector means;
(d) generating a material signal indicative of the material of each article;
(e) conveying each article to a scale means;
(f) generating a weight signal indicative of the weight of each article;
(g) in the absence of at least one of a selected material signal and a selected weight signal for an article, discharging said article to a reject location;
(h) in resonse to the combination of said selected material signal and said selected weight signal for an article, receiving said article in an accept location; and
(i) counting the number of the accepted articles which are received in said accept location.

9. A method as set forth in claim 8 wherein said selected material signal is generated for an article upon said article being formed of aluminum.

10. A method as set forth in claim 8 wherein said selected weight signal is generated for an article upon said article weighing not more than a selected weight.

11. A method as set forth in claim 8 including the steps of:
(a) calculating a reimbursement price based in part on the count of said accepted articles; and
(b) printing said reimbursement price on a ticket.

12. A method as set forth in claim 8 wherein:
(a) said articles are conveyed by a rotary article conveyor means; and including the steps of:
(b) monitoring the rotation of said conveyor means; and
(c) upon sensing the cessation of rotation of said conveyor means because of possible jamming thereof by said articles, rotating said conveyor means in the opposite direction from said first direction to thereby unjam said conveyor means.

13. A method of sorting aluminum cans of selected size and weight ranges from a plurality of articles comprising the steps of:
(a) receiving a plurality of randomly oriented articles in a holding receptacle;
(b) feeding said plurality of articles to a singulating conveyor operative to convey a stream of single articles;
(c) conveying each article to a material detector means;
(d) generating a material signal in cooperation with said material detector means for each article, said material signal being indicative of the material of said article;
(e) conveying each article to a scale means;
(f) generating a weight signal in cooperation with said scale means for each article, said weight signal being indicative of the weight of said article, and said weight signal being a selected weight signal upon a weighed article weighing not more than a selected weight;
(g) in the absence of one of a selected material signal and said selected weight signal for an article, conveying said article to a reject location;

(h) in response to the combination of said selected material signal and said selected weight signal for an article, conveying said article to an accept location;

(i) counting the number of the accepted articles which are conveyed to said accept location; and (j) storing the count of said accepted articles.

14. A method as set forth in claim 13 including the steps of:

(a) calculating a reimbursement price based in part on said count of said accepted articles; and (b) printing said reimbursement price on a ticket.

15. A method as set forth in claim 13 wherein said material signal is generated by the steps of:

(a) generating an electrical signal having a predetermined frequency;

(b) applying said electrical signal to a resonant circuit including at least an inductor;

(c) positioning an article within an electromagnetic field produced by said inductor whereby the impedance of said inductor when driven by said electrical signal at said predetermined frequency is varied in response to the magnetic permeability and conductivity of the material of said article;

(d) measuring the impedance change of said inductor;

(e) in response to a change in the reactive impedance of said inductor within a selected range, generating said selected material signal having a first voltage level; and (f) in response to a change in said reactive impedance other than within said selected range thereof, generating said material signal having a second voltage level.

16. An apparatus for sorting articles comprising:

(a) a material detector operative to provide a material signal indicative of the material of each article;

(b) a scale operative to provide a weight signal indicative of the weight of each article;

(c) an article feed receptacle for receiving a plurality of randomly oriented articles;

(d) article accept means operative to receive selected articles according to the material content and weight thereof;

(e) article reject means operative to discharge articles which are not acceptable according to at least one of the material content and weight thereof;

(f) article conveyor means driven by a conveyor motor and operative to convey said articles one at a time from said receptacle to said material detector, said scale, and one of said accept means and said reject means;

(g) control means having said material detector, said scale, said accept means, said reject means, and said motor connected thereto and operative to effect the reception of said selected articles by said accept means and the discharge of all other articles in response to the respective material signal and weight signal generated for each article; and (h) an accepted article counter operative to count the number of said selected articles which are received by said article accept means.

17. An apparatus as set forth in claim 16 wherein said article conveyor means includes:

(a) a planar, annular article supporting surface positioned at an acute angle with respect to horizontal, said surface including an upper half sector and a lower half sector;

(b) an article conveying wheel rotatably mounted in substantially parallel spaced relation to said surface;

(c) a plurality of circumferentially spaced and outwardly extending article pusher arms operative upon rotation of said wheel to convey said articles about said surface;

(d) cylindrical wall means positioned in surrounding relation to said wheel to maintain the radial position of said articles for conveyance by said wheel;

(e) said surface, said wheel, and said wall means defining an article processing chamber, said receptacle feeding a plurality of articles to said chamber in the vicinity of said lower half sector of said surface for conveyance therefrom by said wheel; and (f) said conveyor motor being operatively connected to said wheel and selectively operable to rotate said wheel.

18. An apparatus as set forth in claim 17 including:

(a) said article pusher arms being spaced apart a distance to provide space between successive arms to receive substantially a single article therebetween; and (b) an article diverter extending from said wall means in spaced relation from said surface and said wheel and operative to dislodge an extra article from between a successive pair of said article pusher arms to result in a single article between said arms.

19. An apparatus as set forth in claim 17 including an agitator vane positioned on said wheel for engagement with said plurality of articles in said article processing chamber to agitate same during rotation of said wheel to separate said articles to thereby lessen the possibility of said apparatus becoming jammed by said articles.

20. An apparatus as set forth in claim 17 wherein:

(a) said article accept means includes an accept door defining a segment of said surface and an accept door actuator connected to said control means for selectively opening and closing said accept door; and (b) said article reject means includes a reject door defining a segment of said surface and a reject door actuator connected to said control means for selectively opening and closing said reject door.

21. An apparatus as set forth in claim 17 wherein said wall means is spaced from an outer periphery of said surface to define a dropout opening to allow articles smaller than a selected size to drop out of said apparatus.

22. An apparatus as set forth in claim 21 including dropout door means positioned at said dropout opening for selectively closing a segment of said opening to prevent said articles smaller than a selected size from dropping out of said apparatus through said segment of said dropout opening.

23. An apparatus as set forth in claim 17 wherein said scale includes:

(a) a scale platform spaced generally below the plane of said surface;

(b) a pair of article supporting rails extending in the circumferential direction of said surface and protruding above the level of said platform; and (c) resilient rail support means urging said rails generally upwardly through said platform.

24. An apparatus as set forth in claim 23 including scale switch means responsive to a selected generally downward deflection of said rails to send an overweight signal to said control means.

25. An apparatus as set forth in claim 24 wherein said scale switch means includes:

(a) photoswitch means including a light emitting diode and a phototransistor receiving and responsive to light from said diode; and (b) light interrupter means positioned on said rails for interposition between said diode and said phototransistor upon said selected downward deflection of said rails.

26. An apparatus as set forth in claim 23 wherein said resilient rail support means includes:

(a) a rigid support positioned radially inwardly from said scale; and (b) a resilient cantilever beam extending radially outwardly from said rigid support and having said rails mounted on a free end thereof.

27. An apparatus as set forth in claim 17 including an article kicker positioned at an entry end of said scale and operative to kick an article ahead of the respective pusher arm pushing said article and onto said scale for weighing of said article without contact by said respective pusher arm.

28. An apparatus as set forth in claim 16 wherein said material detector includes:

(a) oscillator means providing an electrical signal having a predetermined frequency;

(b) a resonant circuit operatively connected to said generator means and including at least an inductor positioned on said apparatus for the placement of an article within an electromagnetic field produced by said inductor; and (c) impedance measuring means operatively connected to said inductor and providing said material signal having a voltage level indicative of a change in the impedance of said inductor upon the entry of an article into the field of said inductor.

29. An apparatus as set forth in claim 28 wherein:

(a) said material detector is adapted to provide a digital material signal;

(b) said material signal has a selected logic level for an article upon said article being formed of aluminum; and (c) said material signal has a level which is the logical complement of said selected logic level for an article upon said article not being formed of aluminum.

30. An apparatus as set forth in claim 16 wherein said apparatus is adapted for sorting metallic cans and wherein:

(a) said material detector provides an acceptable material signal upon detecting that a can is aluminum;

(b) said scale provides an acceptable weight signal upon a can weighing not greater than a selected weight; and (c) said control means is responsive to the combination of an acceptable material signal and an acceptable weight signal for the same can to effect actuation of said article accept means.

31. An apparatus as set forth in claim 16 wherein said control means includes a digital computer.

32. An apparatus as set forth in claim 16 wherein:

(a) said control means is operative to calculate a reimbursement price based in part on said number of said selected articles which are received by said accept means; and (b) a printer is connected to said control means and is operative to print said reimbursement price on a ticket.

33. An apparatus for sorting cans comprising:

(a) a planar, annular can supporting surface positioned at an acute angle with respect to horizontal, said surface having an upper and a lower portion;

(b) a can conveying wheel rotatably mounted in substantially parallel spaced relation to said surface, said wheel including a plurality of circumferentially spaced and outwardly extending can pusher arms operative upon rotation of said wheel to convey said cans about said surface;

(c) cylindrical wall means positioned in surrounding relation to said wheel to maintain the radial position to said cans for conveyance by said wheel;

(d) motor means operatively connected to said wheel and selectively operable to rotate said wheel;

(e) metal detector means positioned in spaced relation to a segment of said surface and operative to provide a metal detector signal indicative of the type of metal of each can tested by said metal detector means;

(f) scale means defining a segment of said surface and operative to provide a weight signal indicative of the weight of each can;

(g) an accept door defining a segment of said surface and including accept door actuator means for selectively opening and closing said accept door;

(h) a reject door defining a segment of said surface and including reject door actuator means for selectively opening and closing said reject door;

(i) control means interconnected with said motor means, said metal detector means, said scale means, said accept door actuator means, and said reject door actuator means and operative upon selected combinations of said metal detector signal and said weight signal to open one of said accept door and said reject door to receive a can therethrough; and (j) counter means operative to count the number of cans received through said accept door.

* * * * *